US011162255B2

(12) United States Patent
Wheatley, III

(10) Patent No.: US 11,162,255 B2
(45) Date of Patent: Nov. 2, 2021

(54) APPARATUS FOR INTERCONNECTING WOODEN MEMBERS

(71) Applicant: Thomas F Wheatley, III, Granby, CO (US)

(72) Inventor: Thomas F Wheatley, III, Granby, CO (US)

( * ) Notice: Subject to any disclaimer, the term of this patent is extended or adjusted under 35 U.S.C. 154(b) by 385 days.

(21) Appl. No.: 16/441,485

(22) Filed: Jun. 14, 2019

(65) Prior Publication Data

US 2020/0392720 A1 Dec. 17, 2020

(51) Int. Cl.
*E04B 1/26* (2006.01)
*E04H 17/14* (2006.01)

(52) U.S. Cl.
CPC ..... *E04B 1/2604* (2013.01); *E04H 17/1417* (2013.01); *E04H 17/1447* (2021.01); *E04B 2001/2644* (2013.01)

(58) Field of Classification Search
CPC ..... E04B 1/2604; E04B 2001/2644; E04B 2001/2648; E04B 2001/2684; E04H 17/1417; E04H 17/1447; E04H 12/2261; E04H 12/2238
See application file for complete search history.

(56) References Cited

U.S. PATENT DOCUMENTS 736,058 A * 8/1903 Beazley ..... E02D 27/02 52/292
5,342,138 A * 8/1994 Saito ..... E04H 12/2261 403/189
5,577,856 A * 11/1996 Tezuka ..... E04B 1/2604 403/294
5,660,492 A * 8/1997 Bathon ..... C09J 5/00 403/265
5,938,369 A * 8/1999 Peters ..... E04B 1/2604 403/400
5,941,044 A * 8/1999 Sera ..... E04B 1/2604 52/655.1
5,954,447 A * 9/1999 Bathon ..... C09J 5/00 403/267
6,669,396 B2 * 12/2003 Mattle ..... F16B 25/0057 403/294
7,788,785 B2 * 9/2010 Platt ..... E04H 17/1447 29/525.01
9,920,531 B1 * 3/2018 Charest ..... E04C 3/12
10,100,508 B1 * 10/2018 Fox ..... E04B 7/063
10,422,123 B2 * 9/2019 Holland ..... E04B 1/2612
11,098,489 B1 * 8/2021 Wheatley, III .... E04F 15/02044
2002/0025217 A1 * 2/2002 Mattle ..... F16B 25/0031 403/294
2007/0186503 A1 * 8/2007 Homma ..... E04B 1/2604 52/655.1
2009/0190996 A1 * 7/2009 Clarke ..... F16B 2/065 403/188
2009/0267041 A1 * 10/2009 Platt ..... E04H 17/1417 256/65.04
2013/0028657 A1 * 1/2013 Kenho ..... E04B 1/2604 403/188

(Continued)

*Primary Examiner* — Rodney Mintz
(74) *Attorney, Agent, or Firm* — Hanes & Bartels LLC

(57) ABSTRACT

Apparatus for interconnecting wooden members that includes a V shaped pair of flanges that are fixed to an L shaped bracket which bracket is adapted to be attached to one wooden member and where the flanges are adapted to be inserted into V slots on a second wooden member.

3 Claims, 7 Drawing Sheets

(56) References Cited

U.S. PATENT DOCUMENTS

| | | | | |
|---|---|---|---|---|
| 2013/0292624 | A1* | 11/2013 | Bergman | E04H 17/1417 256/65.03 |
| 2015/0082735 | A1* | 3/2015 | Truckner | E04H 12/2292 52/655.1 |
| 2018/0127971 | A1* | 5/2018 | Holland | E04B 1/2612 |

* cited by examiner

APPARATUS FOR INTERCONNECTING WOODEN MEMBERS

The present invention relates to apparatus for interconnecting wooden members to other wooden members or to concrete.

BACKGROUND

The prior art has seen a number of issued patents and publications relating to bracket devices for interconnecting various structural members, U.S. Pat. No. 7,788,785 to Platt for Method of Connecting a Fence Rail to a Fence Post Using a Rail Clip Assembly and U.S. Pat. No. 10,100,508 to Fox for Rafter Bracket and published U.S. Patent Application No. 2013/0292624 by Bergman for Apparatus and Method for Connecting a Rail or Structural Member to a Post or Other Member are illustrative of such prior art. While these and many other such connection devices have their advantages, it is the primary object of the present invention to provide a modified bracket that will simplify and improve the efficiency of connecting the bottom of a post to a base, such as a concrete footer. The versatility of the present invention also provides increased simplicity in interconnecting wooden structural members.

DETAILED DESCRIPTION OF THE INVENTION

Figure 1:
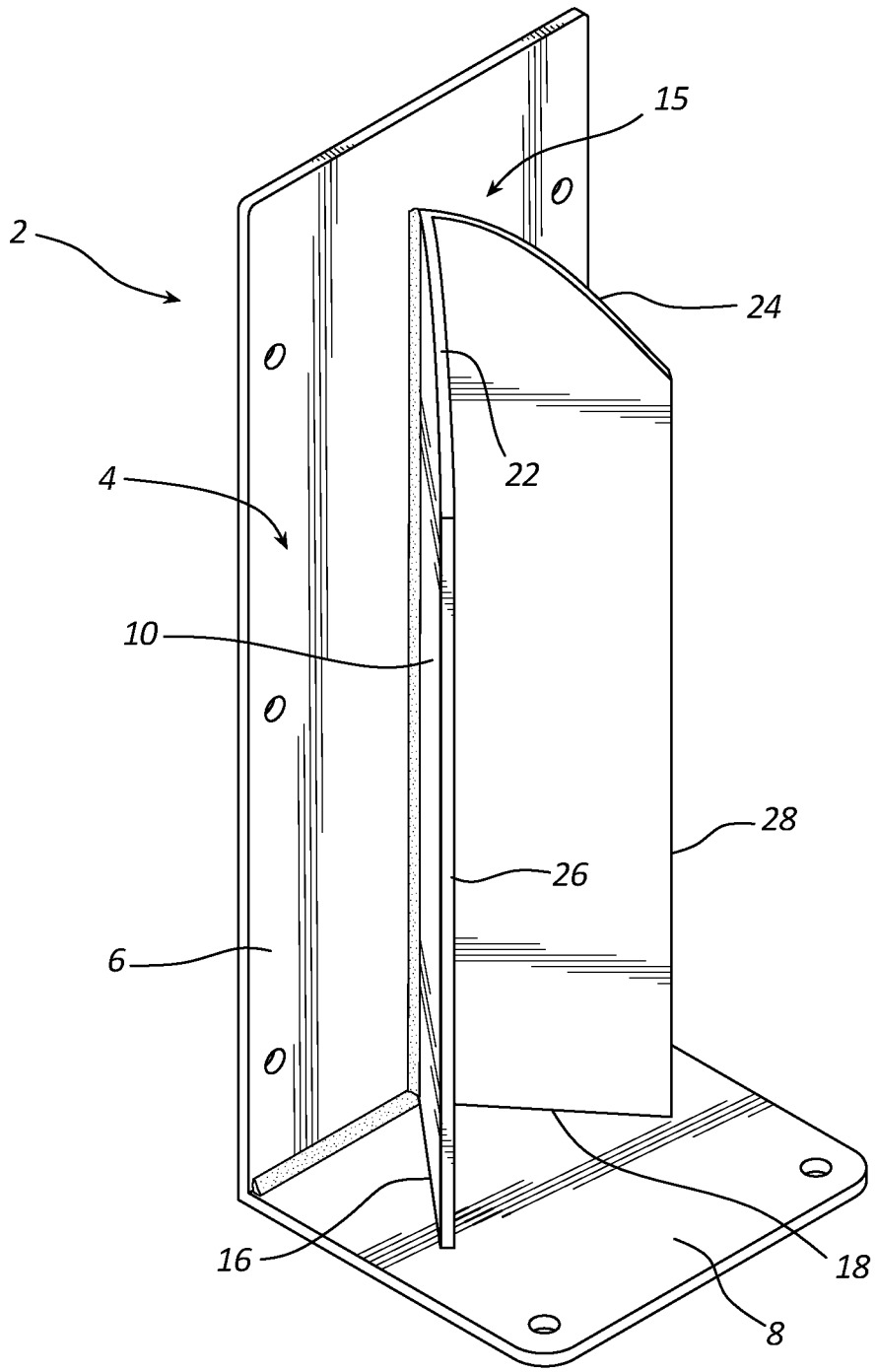
FIG. 1 is a perspective view of the modified L shaped bracket of the present invention.
Figure 3:
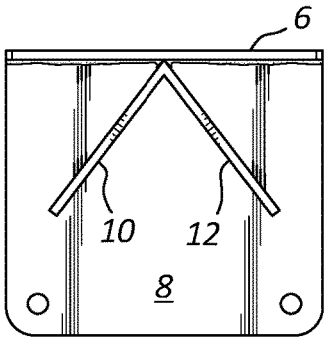
FIG. 3 is a top view of the modified bracket.
Figure 5:
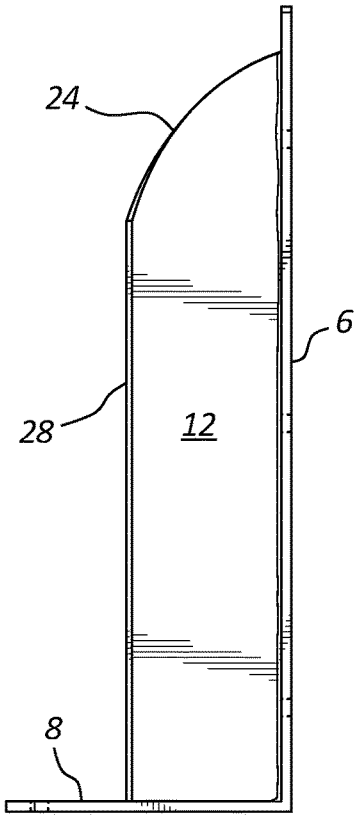
FIG. 5 is a left side view of the modified bracket.
Figure 2:
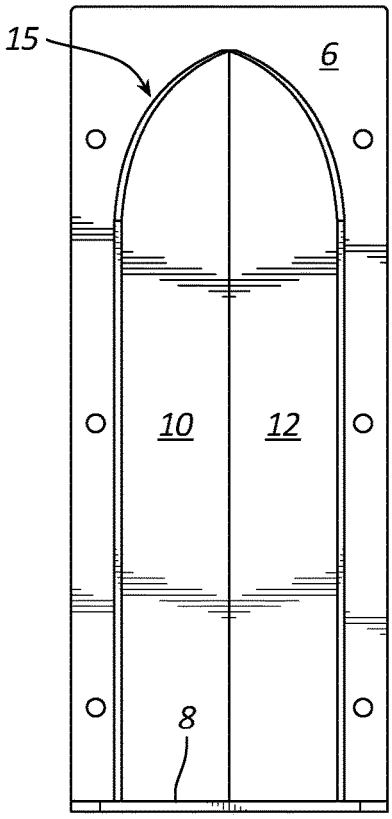
FIG. 2 is a front view of the modified bracket.
Figure 6:
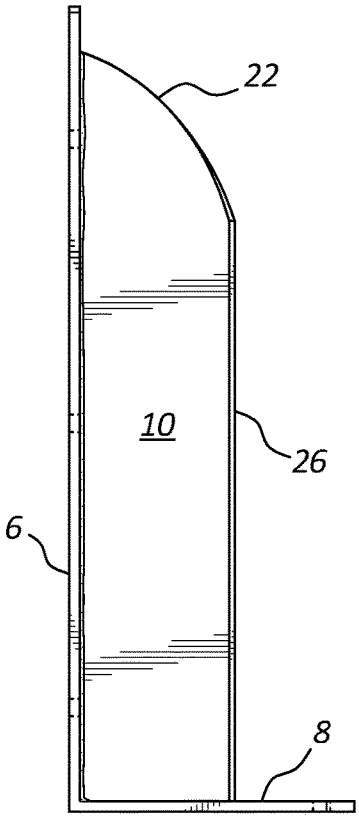
FIG. 6 is a right side view of the modified bracket.
Figure 4:
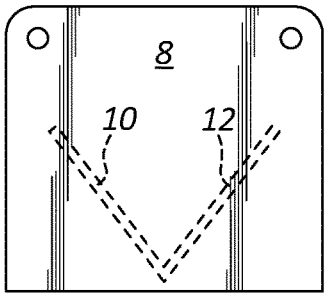
FIG. 4 is a bottom view of the modified bracket.

Referring first to FIG. 1, the modified bracket of the present invention is referred to generally by reference numeral 2. An L shaped rigid bracket 4 is illustrated as having an elongated arm 6 and a short arm 8 that are mutually perpendicular. A pair of rigid flanges 10 and 12 are interconnected, as by welding, for example, along their straight edges forming a V shaped structure 15. The welded interconnection of the flanges 10 and 12 forms the base of the V structure. The base of the V structure is welded or otherwise fixedly attached to the upstanding arm 6 of the bracket 4, the attachment being along the longitudinal midline of the bracket arm.

The first terminal ends 16 and 18 of the flanges 10 and 12 are straight and are co-planar and are fixedly attached, by welding or other means, to the horizontally disposed arm 8 of the bracket 4.

The second terminal ends 22 and 24 of the flanges 10 and 12 are curvilinear in shape developing into straight longitudinal edges 26 and 28 of the respective flanges 10 and 12.

Figure 7:
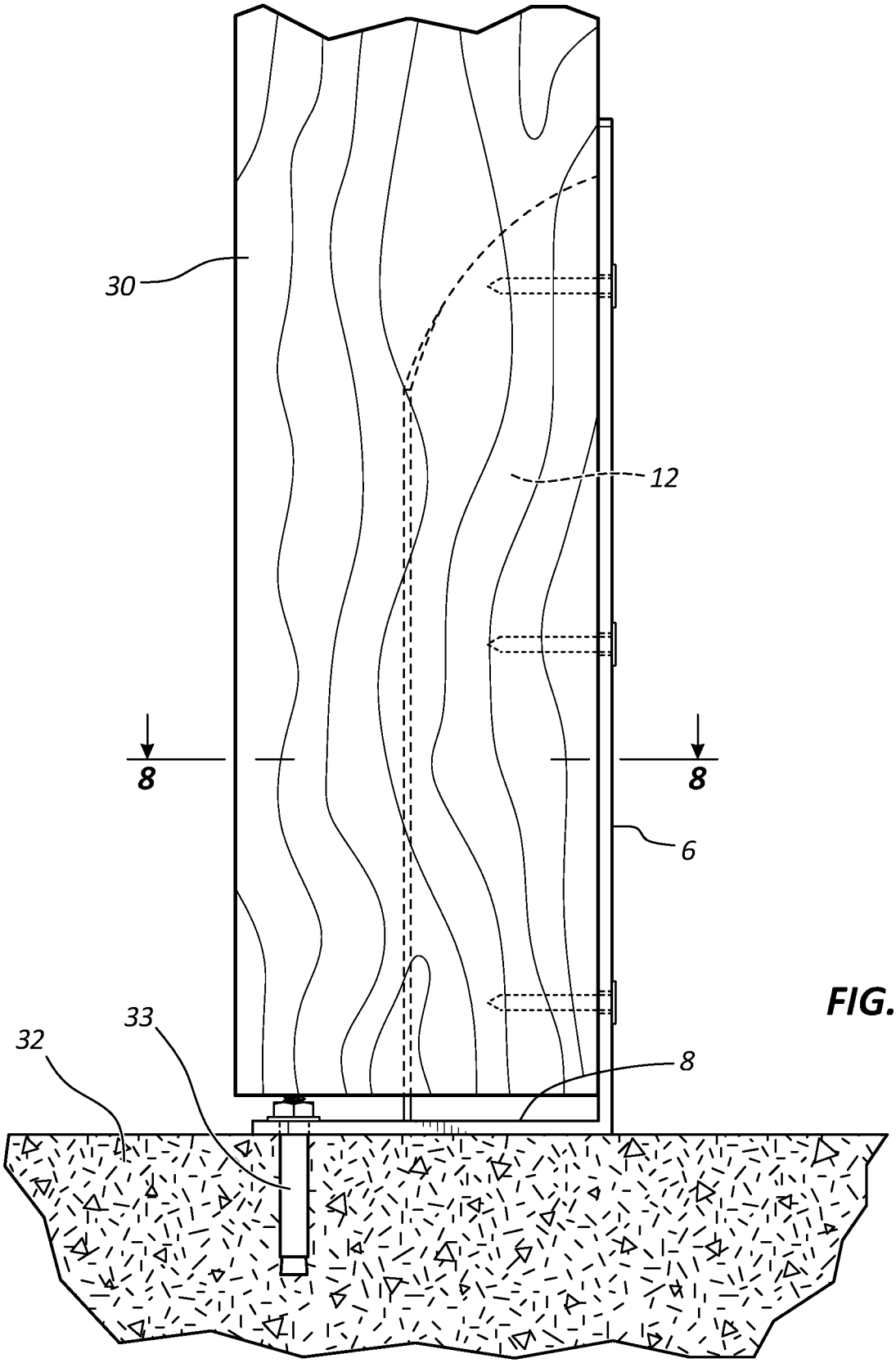
FIG. 7 is a side view of a post mounted on a concrete base, shown in cross section, utilizing the modified bracket of the present invention.
Figure 8:
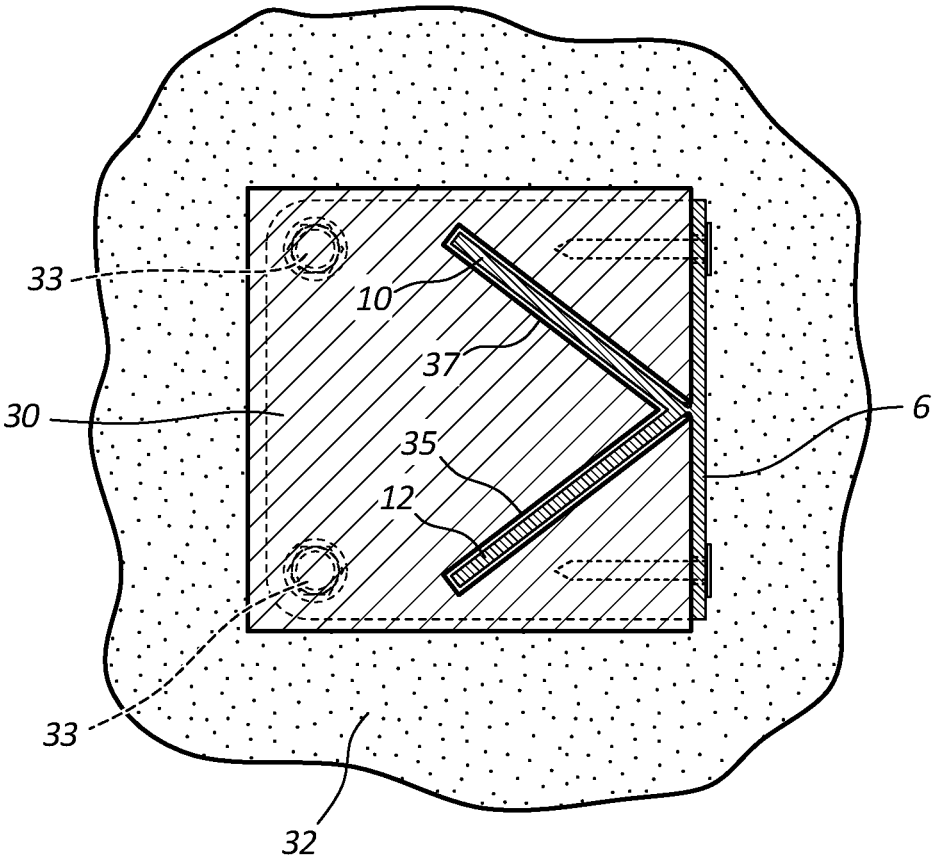
FIG. 8 is a cross sectional view taken along lines 8-8 of FIG. 7.
Figure 9:
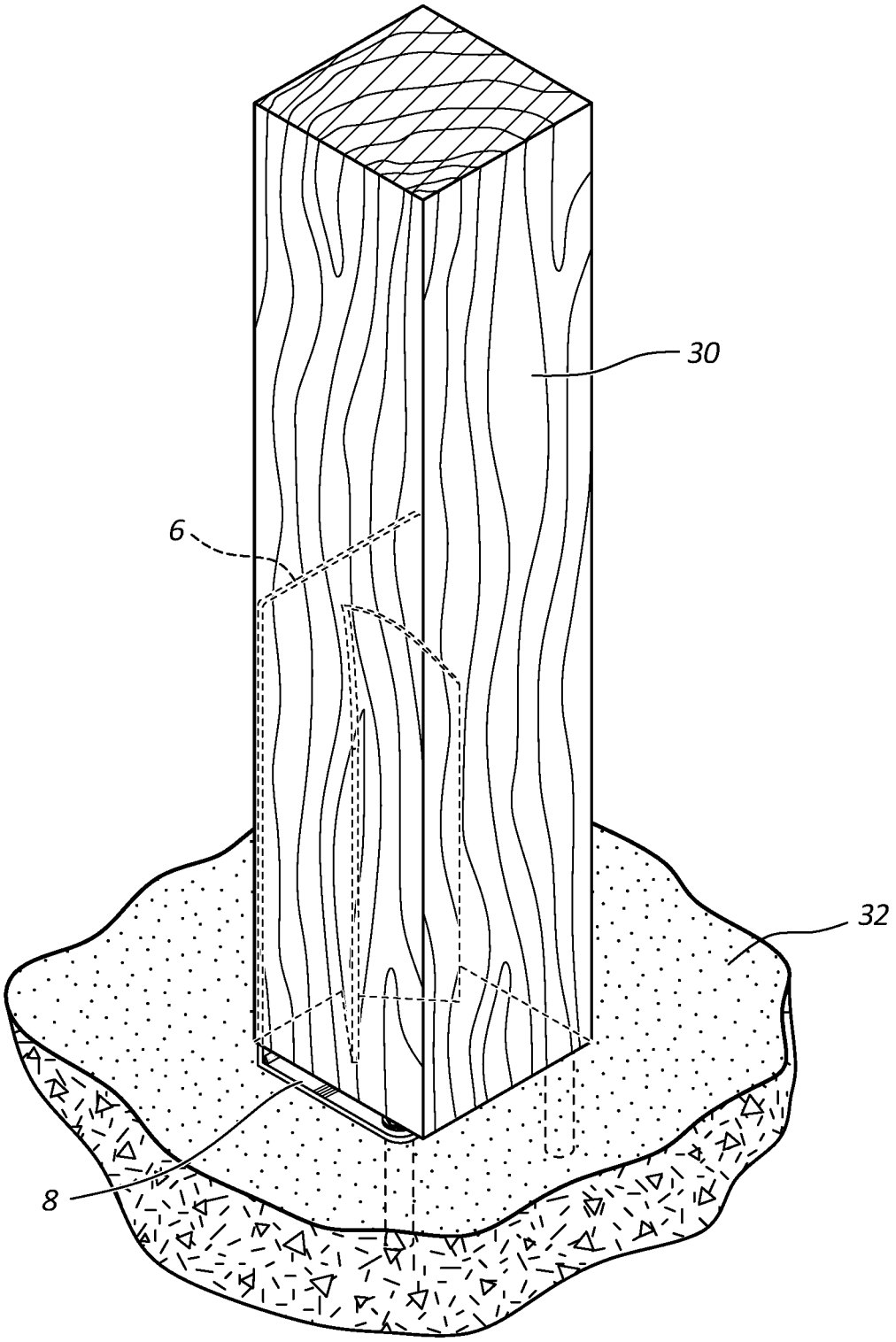
FIG. 9 is a perspective view of the post and concrete base shown in FIG. 7.

FIGS. 7-9 illustrate how the modified L shaped bracket 2 anchors a post 30 to a concrete base 32. The horizontally disposed arm 8 of the bracket 4 is attached to the concrete base with bolts 33 that are placed through apertures in the arm 8 and into the concrete base.

Starting at the end of the post that is to be anchored to the concrete base, a first angular mortice 35 is sawed into the flat side of the post, the mortice having a length equal to the length of the V shaped structure 15. A second similar mortice 37 is angularly sawed into the same flat side and positioned so that the open side of the second mortice unites with the open side of the first mortice. The angle between the two mortice channels is the same angle as exists between the flanges 10 and 12 of the V shaped structure 15.

The flanges 10 and 12 are slid into the tight fitting mortice channels until the end of the post is flush against the bolts that anchor the arm 8 of the bracket 4 to the concrete base. Preferably, the mortice channels are filed with epoxy or glue to improve the bond between the post and the flanges. With the post in the proper position on the bracket 4, the elongated arm 6 is bolted or screwed into the side of the post having the mortice channels.

Figure 10:
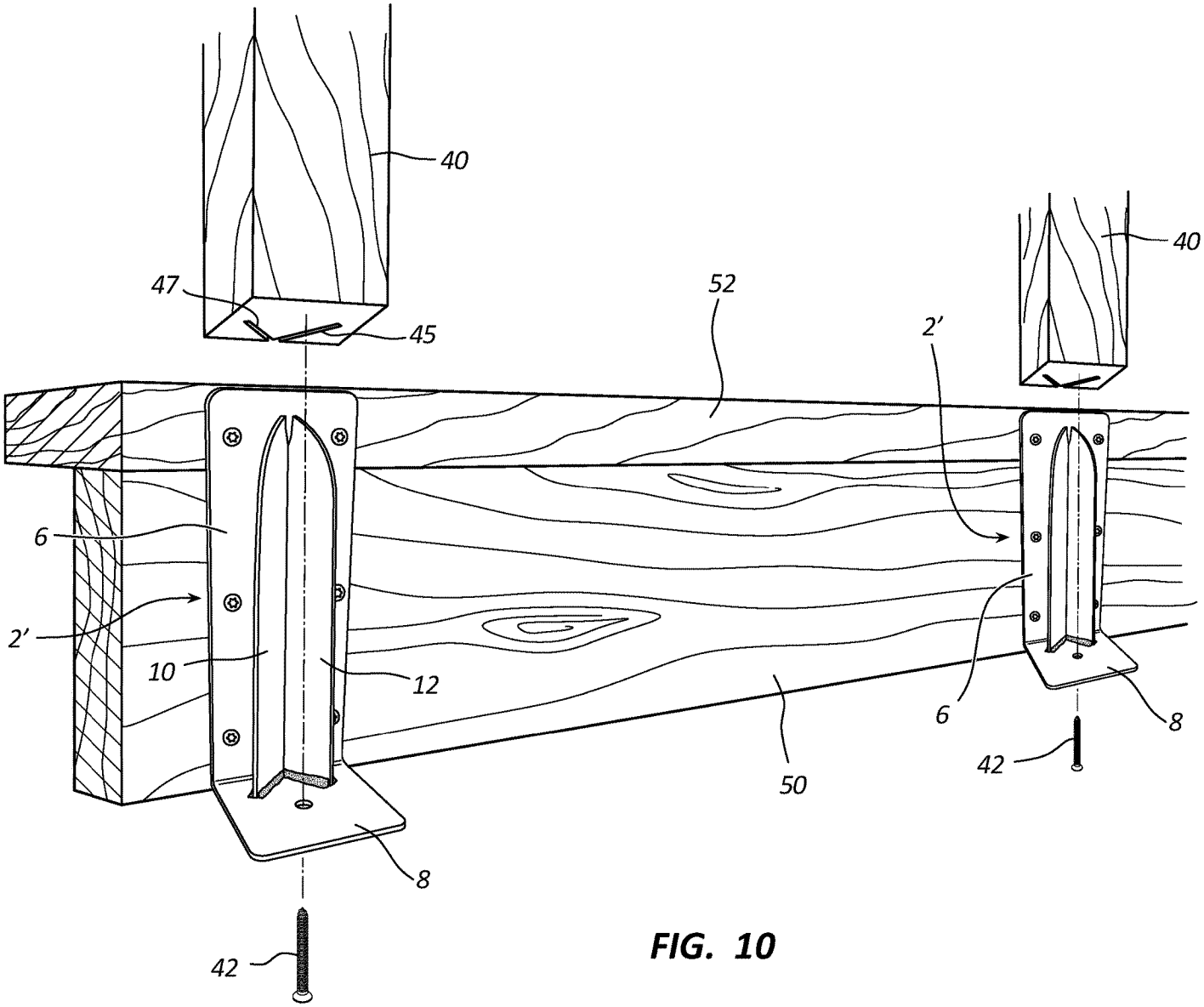
FIG. 10 is a perspective view of a wooden beam structure to which the modified bracket of the present invention is attached and ready to receive vertical posts which are to be affixed to the beam structure.
Figure 11:
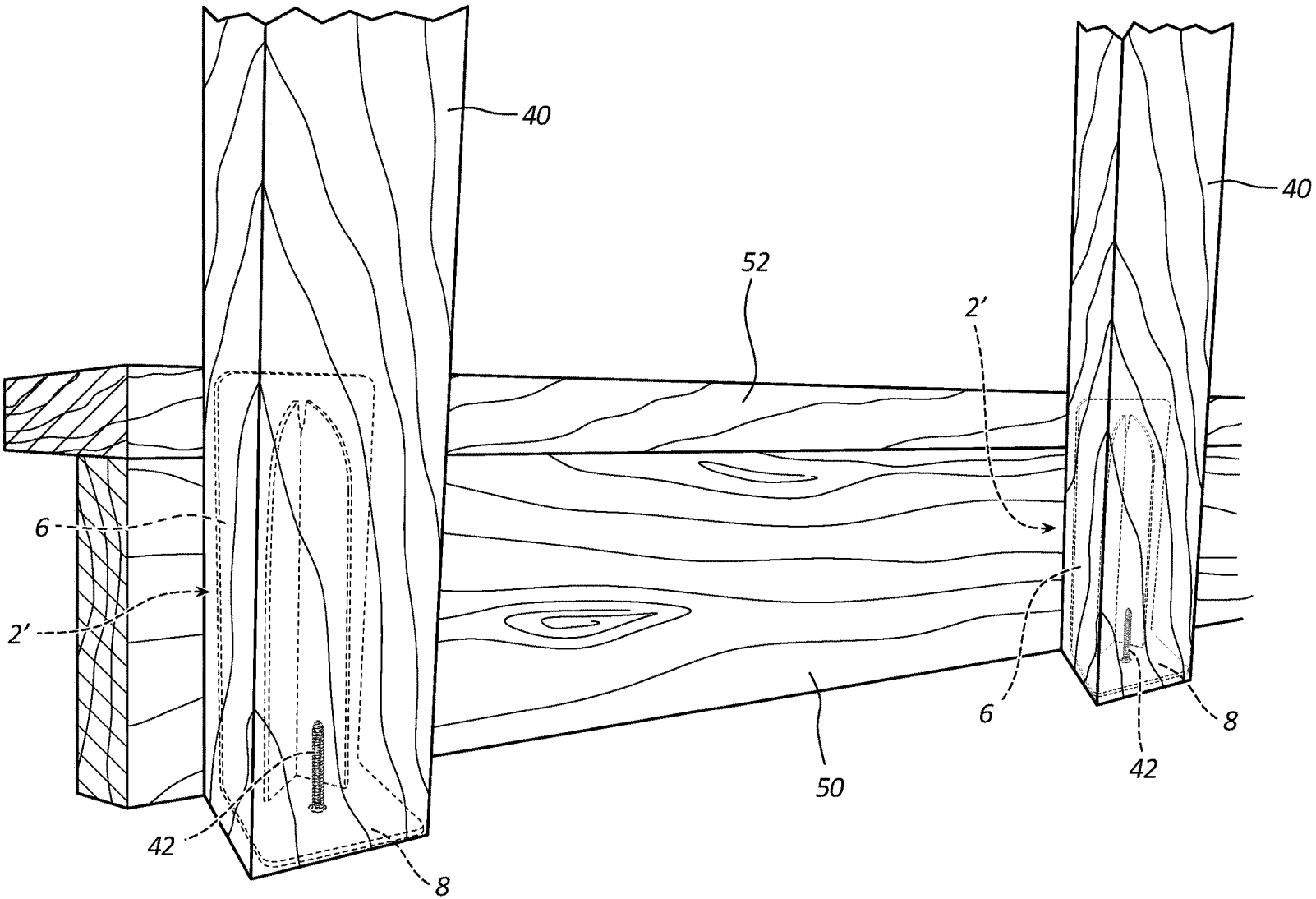
FIG. 11 is a view similar to that of FIG. 10 but showing the vertical posts in their fixed position with the modified bracket and flanges shown in dotted lines.

FIGS. 10 and 11 illustrate how the modified bracket 2 can be used to interconnect wooden members, such as a wooden beam 50 and 52, forming the side of a deck structure, and vertical posts 40 that support a handrail. The elongated arm 6 of the L shaped bracket 2 is attached to the structural beam 50, 52 by screws or bolts through apertures in the arm. A post 40 having mortices 47 and 45 is attached to the bracket 2 by inserting the second terminal ends 22 and 24 of the flanges 10 and 12 of the bracket into the respective mortices 47 and 45 and sliding the post down onto the bracket so that the bottom surface of the post is flush against the short arm 8 of the bracket, as seen in FIG. 11. A screw 42 is passed through an aperture in the arm 8 and into the bottom of the post to secure the post vertically on the bracket 2.

I claim:

1. Apparatus for interconnecting first and second wooden members, comprising, an L-shaped rigid bracket having first and second mutually perpendicular arms, first and second flat rigid plates, each said plate having at least one straight longitudinal edge and a straight first terminal end, where the plates are angularly interconnected along the straight longitudinal edges thereby defining a V-shaped structure having a base and where the base of the V-shaped structure is fixedly attached to the first arm of the bracket and the straight first terminal ends of the plates are co-planar and fixedly attached to the second arm of the bracket, where the base of the V-shaped structure is attached to the first arm of the bracket along a longitudinal midline of the first arm of the bracket, and where the bracket is configured to be attached to the first wooden member and the plates are configured to be inserted into V-shaped slots located in the second wooden member.

2. The apparatus of claim 1 where each of the plates comprise a second terminal end opposite the straight first terminal end which second terminal ends are longitudinally curvilinear.

3. The apparatus of claim 1 and further including a plurality of apertures in the first and second arms of the bracket.

* * * * *